US011009822B2

(12) United States Patent
Itoyama

(10) Patent No.: US 11,009,822 B2
(45) Date of Patent: May 18, 2021

(54) POWDER DETECTION DEVICE AND TONER REPLENISHMENT DEVICE

(71) Applicant: Sharp Kabushiki Kaisha, Sakai (JP)

(72) Inventor: Motoyuki Itoyama, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 549 days.

(21) Appl. No.: 15/492,041

(22) Filed: Apr. 20, 2017

(65) Prior Publication Data

US 2017/0308020 A1 Oct. 26, 2017

(30) Foreign Application Priority Data

Apr. 25, 2016 (JP) ..... JP2016-086813

(51) Int. Cl.
*G03G 15/00* (2006.01)
*G03G 21/00* (2006.01)

(52) U.S. Cl.
CPC ..... *G03G 15/556* (2013.01); *G03G 21/0011* (2013.01)

(58) Field of Classification Search
None
See application file for complete search history.

(56) References Cited

U.S. PATENT DOCUMENTS

| | | | | |
|---|---|---|---|---|
| 4,135,642 | A * | 1/1979 | Forward | G03G 15/0856 222/23 |
| 5,398,106 | A | 3/1995 | Eguchi | |
| 5,805,952 | A * | 9/1998 | Buch | G03G 15/0872 399/120 |
| 8,032,038 | B2 * | 10/2011 | Ushikubo | G03G 15/0865 399/258 |
| 2010/0239274 | A1 * | 9/2010 | Sato | G03G 15/0856 399/29 |
| 2013/0058670 | A1 | 3/2013 | Nakatake et al. | |
| 2015/0132018 | A1 * | 5/2015 | Sakaya | G03G 15/0862 399/27 |
| 2017/0010577 | A1 * | 1/2017 | Maehara | G03G 21/00 |

FOREIGN PATENT DOCUMENTS

| | | | |
|---|---|---|---|
| JP | 05-197281 | A | 8/1993 |
| JP | 2008-185950 | A | 8/2008 |
| JP | 2012-208464 | A | 10/2012 |
| JP | 2014-021364 | A | 2/2014 |

* cited by examiner

*Primary Examiner* — Roy Y Yi
(74) *Attorney, Agent, or Firm* — Keating & Bennett, LLP

(57) ABSTRACT

A toner detection device includes sensor cases, optical sensors, a cleaning member, a motor, and a control unit. The sensor cases include detection surfaces and are placed on wall surfaces of a hopper container. The optical sensors are housed in the sensor cases and detect presence or absence of toner at a specified elevation through the detection surfaces. The cleaning member slides and rubs on the detection surfaces. The motor moves the cleaning member. In case where the cleaning member is to be stopped, the control unit controls the motor so as to stop the cleaning member in a region in which the cleaning member does not come into contact with the detection surfaces.

7 Claims, 14 Drawing Sheets

POWDER DETECTION DEVICE AND TONER REPLENISHMENT DEVICE

BACKGROUND

1. Field

The present disclosure relates to a powder detection device that detects powder such as toner and a toner replenishment device that includes the powder detection device.

2. Description of the Related Art

In an electrophotographic image forming apparatus, toner is supplied from a development tank onto an electrostatic latent image formed on an electrostatic latent image carrier and the electrostatic latent image is thereby visualized into a toner image. The toner is consumed when the electrostatic latent image is visualized into the toner image and thus the development tank has to be replenished with toner. Some development devices further include a toner replenishment device and a toner cartridge in addition to the development tank. The development tank contains the toner to be supplied to the electrostatic latent image carrier. The toner cartridge contains the toner for replenishment and, when the contained toner is exhausted, the toner cartridge is replaced by a new toner cartridge filled with toner. The toner replenishment device is connected to the development tank and the toner cartridge is detachably attached to the toner replenishment device. The toner replenishment device replenishes the toner so that toner concentration in the development tank may be kept fixed. The toner replenishment device includes a powder container that stores the toner. The powder container is supplied with the toner from the toner cartridge so that a top face of the stored toner may not fall below a specified elevation. Therefore, the powder container is provided with a powder detection device that detects presence or absence of the toner at the specified elevation in the powder container.

A conventional powder detection device includes a piezoelectric sensor and determines that toner is present, when there is something in contact with a detection surface of the piezoelectric sensor, and determines that toner is absent, when there is nothing in contact with the detection surface (see Japanese Unexamined Patent Application Publication No. 2014-21364, for instance).

With increase in demands for cost reduction for image forming apparatuses, however, demands for reduction in costs of powder detection devices also have occurred. It is therefore conceivable to use comparatively inexpensive optical sensors in place of the piezoelectric sensor. In case where optical sensors are used in a powder detection device, the optical sensors are housed in sensor cases so that a light-receiving surface of the optical sensor may not be soiled with toner and the toner is detected through detection surfaces of the sensor cases. Therefore, it is conceivable to provide a cleaning member that slides and rubs on the detection surfaces and to thereby clean the detection surfaces of the toner that adheres onto the detection surfaces. In a configuration in which the cleaning member is made to slide and rub on the detection surfaces, however, stoppage of the cleaning member in contact with the detection surfaces may cause the toner interposed between the detection surfaces and the cleaning member for a long time to adhere onto the detection surfaces by pressures produced between the detection surfaces and the cleaning member. In case where the toner adheres onto the detection surfaces, there is a fear of a false positive that tells presence of the toner though the toner is actually absent.

It is desirable to provide a powder detection device that is capable of accurately detecting powder at a low cost and a toner replenishment device that includes the powder detection device.

SUMMARY

A powder detection device of the disclosure includes a sensor case, an optical sensor, a cleaning member, a drive unit, and a control unit. The sensor case is provided on a wall surface of a powder container which contains powder. The sensor case includes a transparent detection surface which is placed so as to face inward in the powder container. The optical sensor is housed in the sensor case and detects presence or absence of the powder at an elevation at which the optical sensor is placed, through the detection surface. The cleaning member slides and rubs on an outer surface of the detection surface. The drive unit moves the cleaning member. The control unit controls the drive unit so as to stop the cleaning member in a region in which the cleaning member does not come into contact with the detection surface, in case where the cleaning member is to be stopped.

DESCRIPTION OF THE EMBODIMENTS

First Embodiment

A powder detection device of the disclosure is embodied as a toner detection device to detect toner that is used in electrophotographic image forming processing, for instance.

A toner detection device according to a first embodiment of the disclosure is applied to an image forming apparatus 1.

Figure 1:
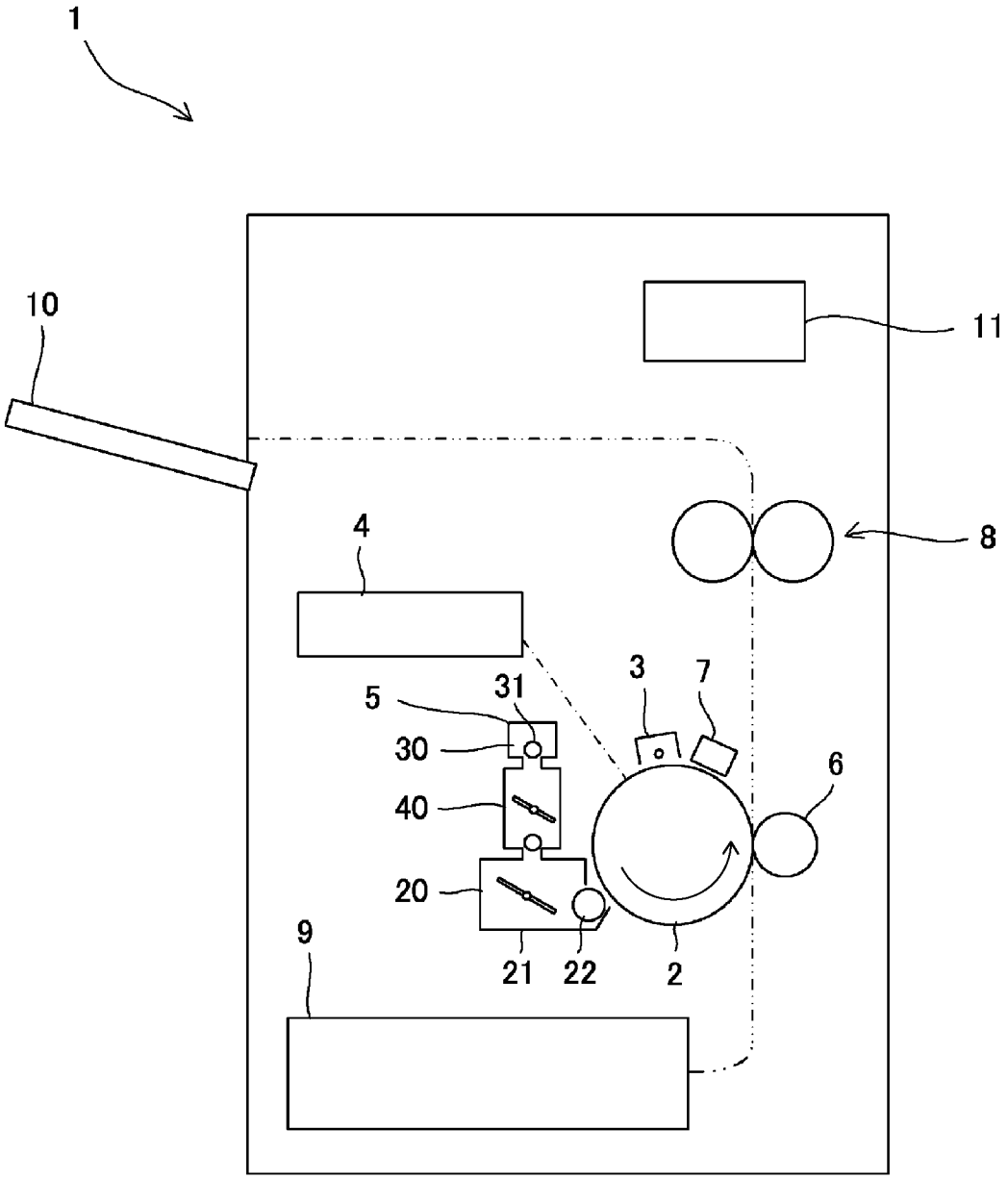
FIG. 1 is a diagram that illustrates a general configuration of an image forming apparatus including a toner detection device according to a first embodiment of the disclosure.

As illustrated in FIG. 1, the image forming apparatus 1 includes a photosensitive drum 2, a charging device 3, an exposing device 4, a development device 5, a transfer device 6, a cleaning unit 7, a fixation device 8, a paper feed tray 9, an output tray 10, and a control unit 11.

The photosensitive drum 2, which is an example of an electrostatic latent image carrier, includes a photosensitive layer on a peripheral surface thereof and rotates in one direction. The charging device 3 charges the peripheral surface of the photosensitive drum 2 at a specified potential. The exposing device 4 forms an electrostatic latent image by exposing the peripheral surface of the photosensitive drum 2. The development device 5 visualizes the electrostatic latent image into a toner image by supplying toner onto the peripheral surface of the photosensitive drum 2.

The paper feed tray 9 supplies a paper sheet to a transfer region where the photosensitive drum 2 and the transfer device 6 face each other. The transfer device 6 transfers the toner image formed on the peripheral surface of the photosensitive drum 2 onto the paper sheet. After the toner image is transferred, the cleaning unit 7 collects the toner remaining on the peripheral surface of the photosensitive drum 2.

The paper sheet onto which the toner image has been transferred is delivered to the fixation device 8. By applying heat and a pressure to the paper sheet, the fixation device 8 fuses the toner and makes the toner image adhere onto the paper sheet. Thus the image is formed on the paper sheet. The paper sheet on which the image is formed is discharged onto the output tray 10. Units and instruments in the image forming apparatus 1 are universally controlled by the control unit 11.

Figure 2:
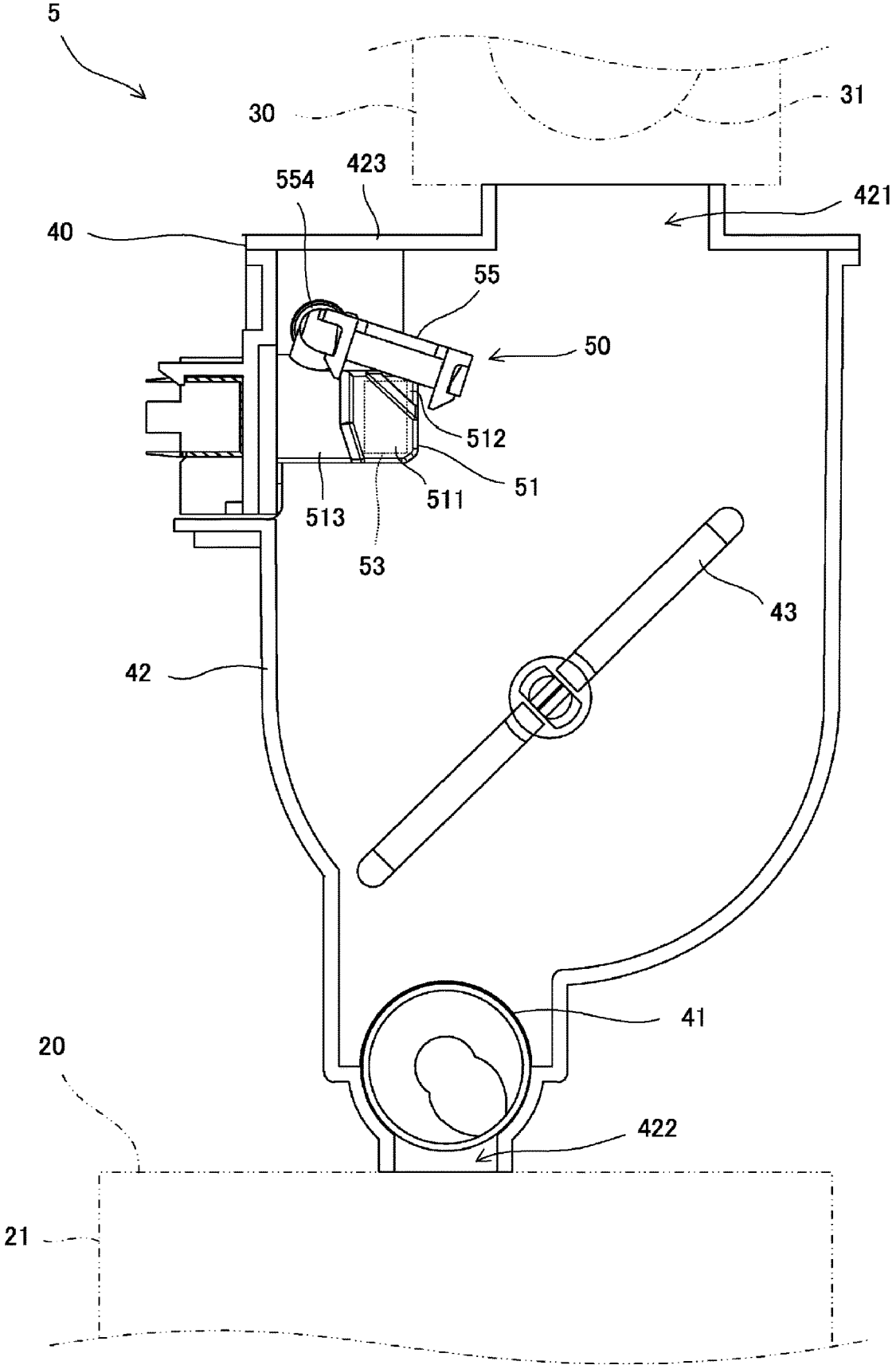
FIG. 2 is a front sectional view of a hopper that is included in a development device provided in the image forming apparatus and that includes the toner detection device.

As illustrated in FIG. 2, the development device 5 includes a development device body 20, a toner cartridge 30, and a hopper 40.

The development device body 20 includes a development tank 21 and a development roller 22 and is placed so as to face the peripheral surface of the photosensitive drum 2. Binary developer including toner and carrier is contained in the development tank 21. The development device body 20 supplies the toner onto the peripheral surface of the photosensitive drum 2 by carrying the toner contained in the development tank 21 on a peripheral surface of the development roller 22 and by rotating the development roller 22. Thus the electrostatic latent image is visualized into the toner image. The toner is consumed when the electrostatic latent image is visualized into the toner image and thus the development tank 21 has to be replenished with the toner.

The toner cartridge 30 includes a supply roller 31 and contains the toner for replenishment. The toner cartridge 30 from which the toner contained therein has been exhausted is replaced by a new toner cartridge 30 filled with toner. The hopper 40 is connected to the development tank 21 and the toner cartridge 30 is detachably attached to the hopper 40. That is, the hopper 40 is placed between the toner cartridge 30 and the development device body 20. The toner discharged from the toner cartridge 30 is temporarily stored in the hopper 40 and is supplied from the hopper 40 into the development tank 21. The hopper 40 is a toner replenishment device that replenishes the development tank 21 to be replenished, with the toner.

A toner concentration sensor not illustrated is provided in the development tank 21 and detects a toner concentration in the development tank 21. The toner concentration sensor is a magnetic permeability sensor, as an instance. A detection result of the toner concentration is outputted to the control unit 11.

When the toner concentration in the development tank 21 is lowered, the control unit 11 makes the hopper 40 replenish the development tank 21 with the toner by rotating a replenishment roller 41 in the hopper 40 so that the toner concentration in the development tank 21 may be maintained at a specified concentration. When an amount of the toner contained in the hopper 40 is lowered, the control unit 11 makes the toner cartridge 30 supply the toner into the hopper 40 by rotating the supply roller 31 in the toner cartridge 30. Thus the toner for replenishment of the development tank 21 from the toner cartridge 30 is temporarily stored in the hopper 40 and the development tank 21 is replenished with the toner from the hopper 40. Even if the toner contained in the toner cartridge 30 has been exhausted, therefore, the toner cartridge 30 can be replaced while the image forming processing is continued.

The hopper 40 has to be replenished with the toner from the toner cartridge 30 so that the amount of the toner contained in the hopper 40 may not fall below a specified value. Therefore, it is detected whether the toner is present or absent at a specified elevation in the hopper 40.

The hopper 40 includes a hopper container 42, a stirring member 43, and a toner detection device 50, in addition to the replenishment roller 41. The hopper container 42 is an example of a powder container.

The hopper container 42 may include a top cover 423, in a top end part thereof, having a receiving port 421. The hopper container 42 may have a discharge port 422, in a bottom end part thereof. The toner supplied from the toner cartridge 30 is received in the hopper container 42 through the receiving port 421 and is temporarily stored in the hopper container 42.

The stirring member 43 is axially supported by and rotated in the hopper container 42. The toner stored in the hopper container 42 is stirred with rotation of the stirring member 43.

The replenishment roller 41 is placed in proximity of the discharge port 422 and is rotated while being axially supported by the hopper container 42. In accordance with a quantity of rotation of the replenishment roller 41, the toner in the hopper container 42 is discharged through the discharge port 422 and the development tank 21 is replenished with the toner.

The toner detection device 50 includes a pair of sensor cases 51, 52, optical sensors 53, 54 (though the optical sensor 54 is not illustrated), and a cleaning member 55. In the embodiment, control over instruments of the toner detection device 50, such as determination of the presence or absence of the toner based on output values from the optical sensors 53, 54 and motion control for the cleaning member 55, is carried out by the control unit 11. The control unit 11 is a component of the toner detection device 50 as well.

Figure 3:
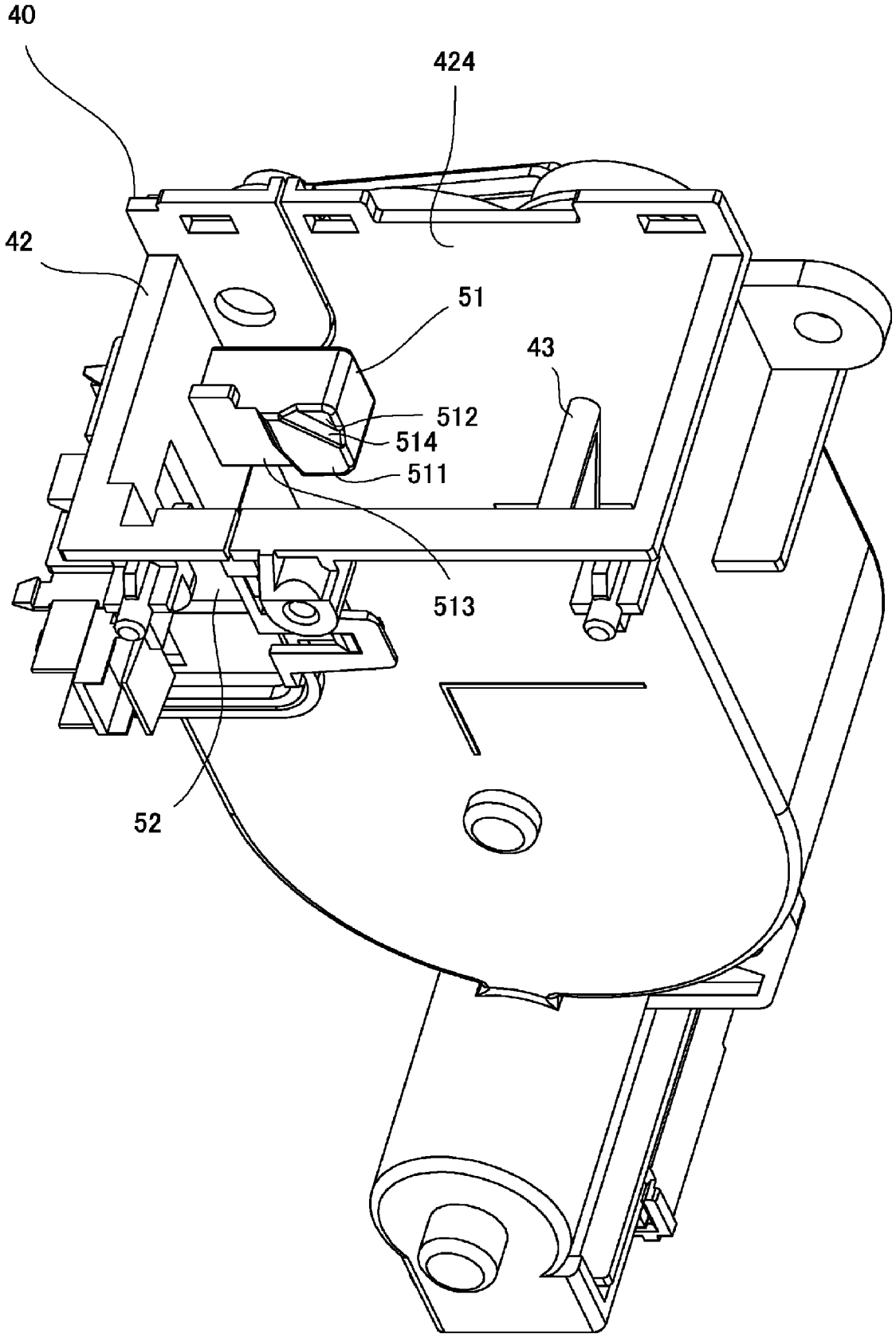
FIG. 3 is a perspective view of the hopper.

As illustrated in FIGS. 2 and 3, the sensor cases 51 and 52 are formed so as to protrude inward respectively from side wall surfaces 424 and 425 of the hopper container 42 at the specified elevation in the hopper container 42. The side wall surface 424 and the side wall surface 425 (see FIG. 5) face each other. In FIG. 3, illustration of the top cover 423 and the cleaning member 55 is omitted.

Figure 4:
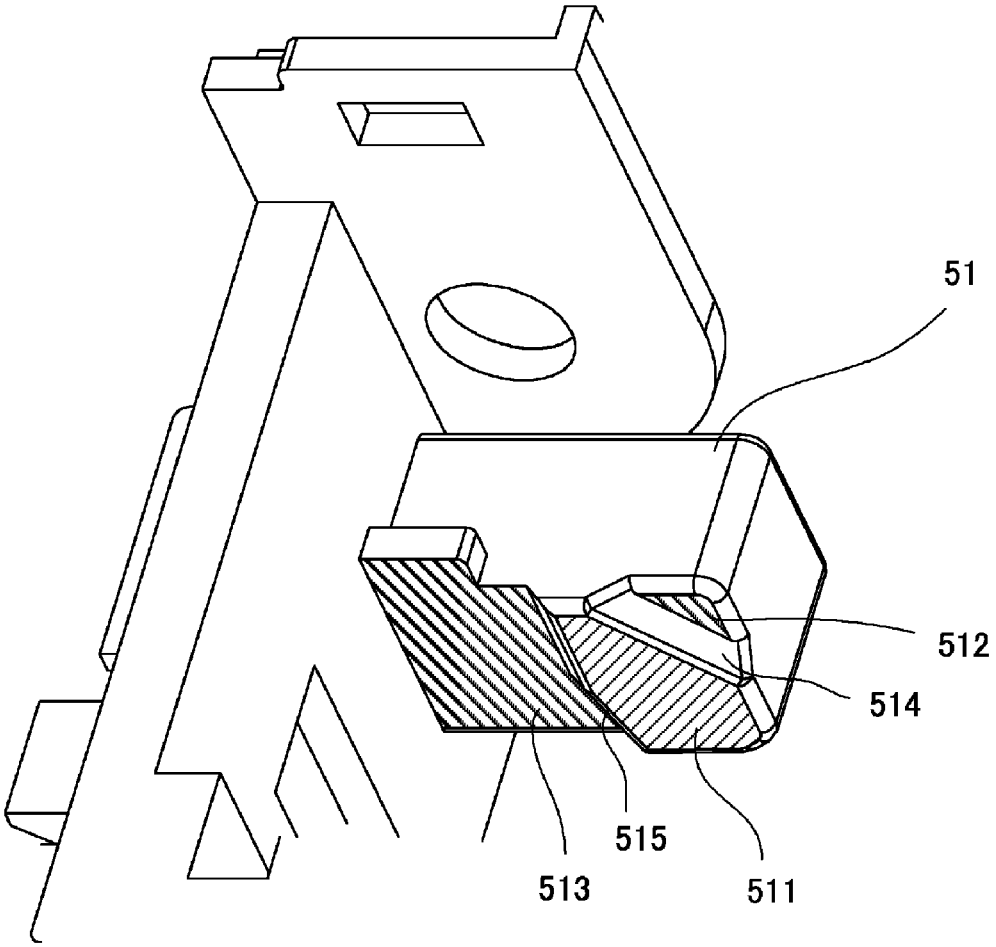
FIG. 4 is a perspective view in which a portion of the hopper is enlarged.

As illustrated in FIG. 4, the sensor case 51 may include a detection surface 511 and step surfaces 512, 513. The detection surface 511 and the step surfaces 512, 513 are substantially parallel to the side wall surface 424 on which the sensor case 51 is provided. The step surfaces 512, 513 are smaller in amount of protrusion from the side wall surface 424 than the detection surface 511 and adjoin the detection surface 511 with step portions 514, 515 between. The detection surface 511 has transparency. In FIG. 4, the detection surface 511 and the step surfaces 512, 513 are hatched for convenience of description.

The sensor case 51 and the sensor case 52 are configured in substantially the same shape. The detection surface 511 of the sensor case 51 and a detection surface of the sensor case 52 face each other.

The optical sensor 53 is housed in the sensor case 51 and the optical sensor 54 is housed in the sensor case 52. In the embodiment, the optical sensor 53 is a light emitting element and, specifically, is a light emitting diode. The optical sensor 54 is a light receiving element and, specifically, is a photo sensor. The optical sensor 53 and the optical sensor 54 detect the toner through the detection surfaces 511 of the sensor cases 51, 52 in which the optical sensors 53, 54 are respectively housed. That is, a light path between the optical sensors 53, 54 extends through specified sites on the detection surfaces 511. A diameter of the light path between the optical sensors 53, 54 is 2.0 mm, as an instance.

In a transmissive state in which any light intercepting factor such as the toner does not exist between the optical sensor 53 and the optical sensor 54, light emitted from the optical sensor 53 is received by the optical sensor 54. In a light interception state in which any light intercepting factor such as the toner exists between the optical sensor 53 and the optical sensor 54, the light emitted from the optical sensor 53 is not received by the optical sensor 54.

Figure 5:
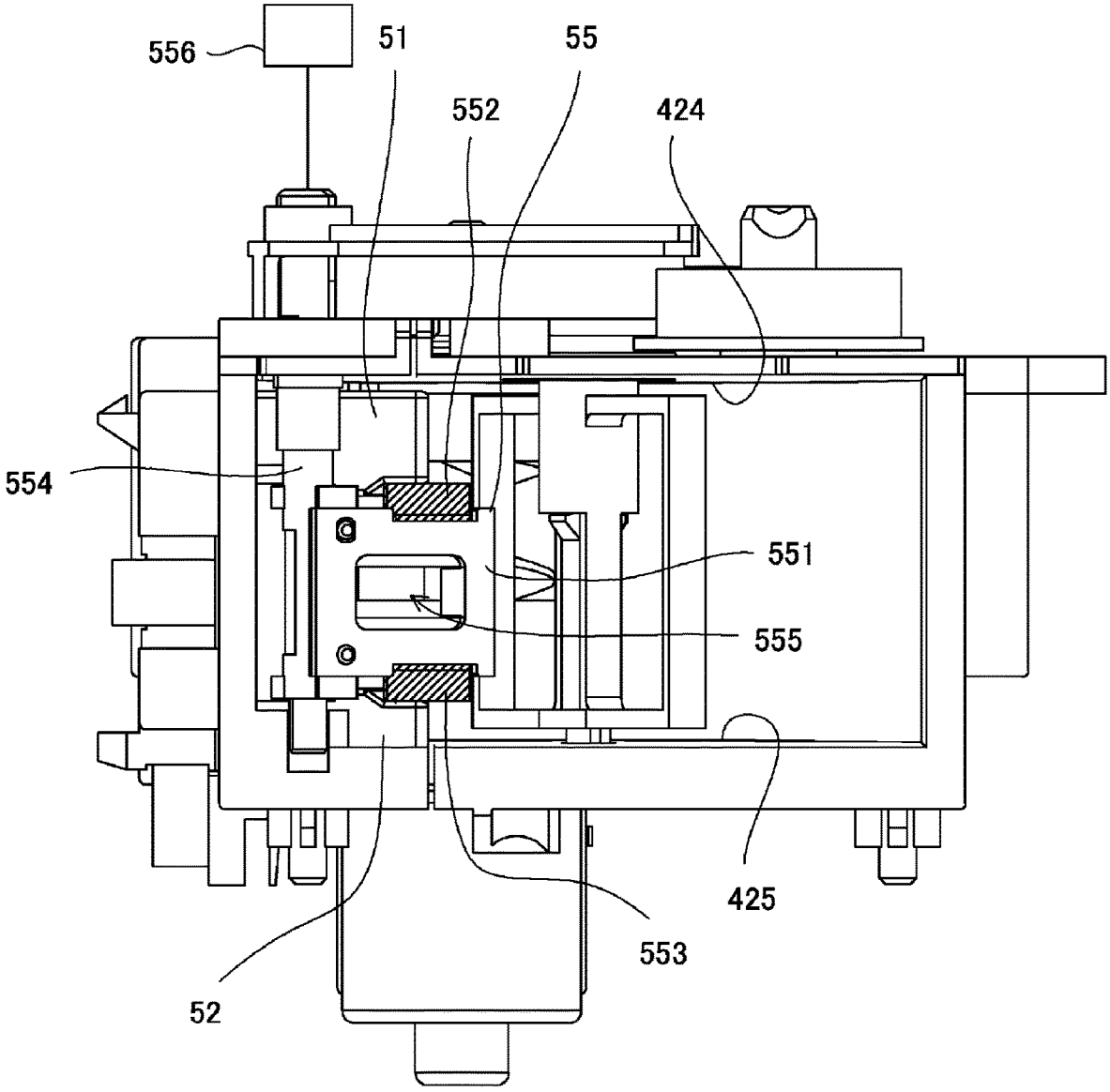
FIG. 5 is a plan view of the hopper.

As illustrated in FIGS. 2 and 5, the cleaning member 55 may include a support member 551 and flexible members 552, 553. The support member 551 is supported by a shaft portion 554 extending in a direction that is horizontal and that is orthogonal to the side wall surfaces 424, 425 and is rotated and moved about the shaft portion 554. The shaft portion 554 is rotated by a driving force of a motor 556. The motor 556 is a drive unit that moves the cleaning member 55.

Figure 6:
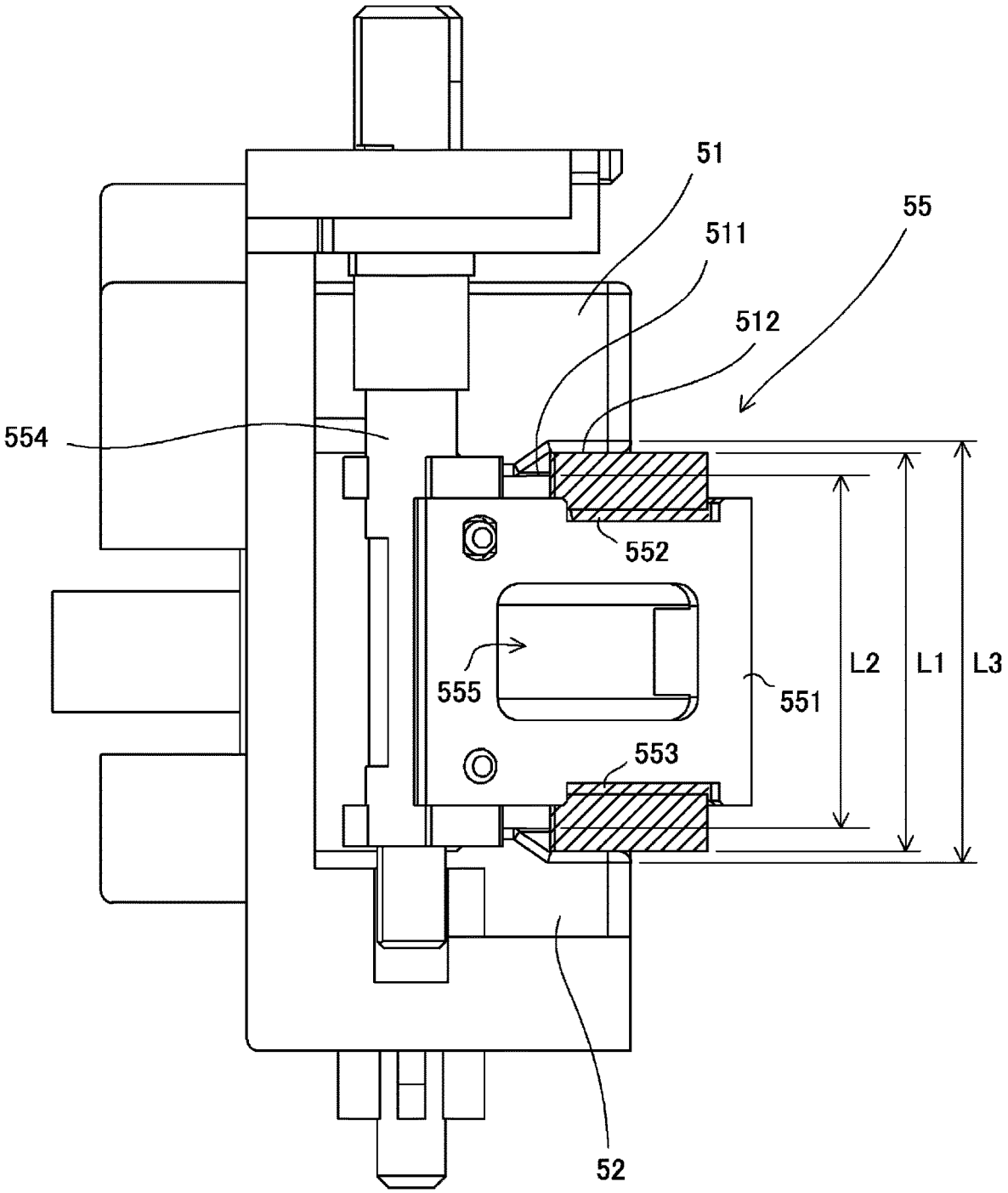
FIG. 6 is a plan view in which a portion of the hopper is enlarged.
Figure 8:
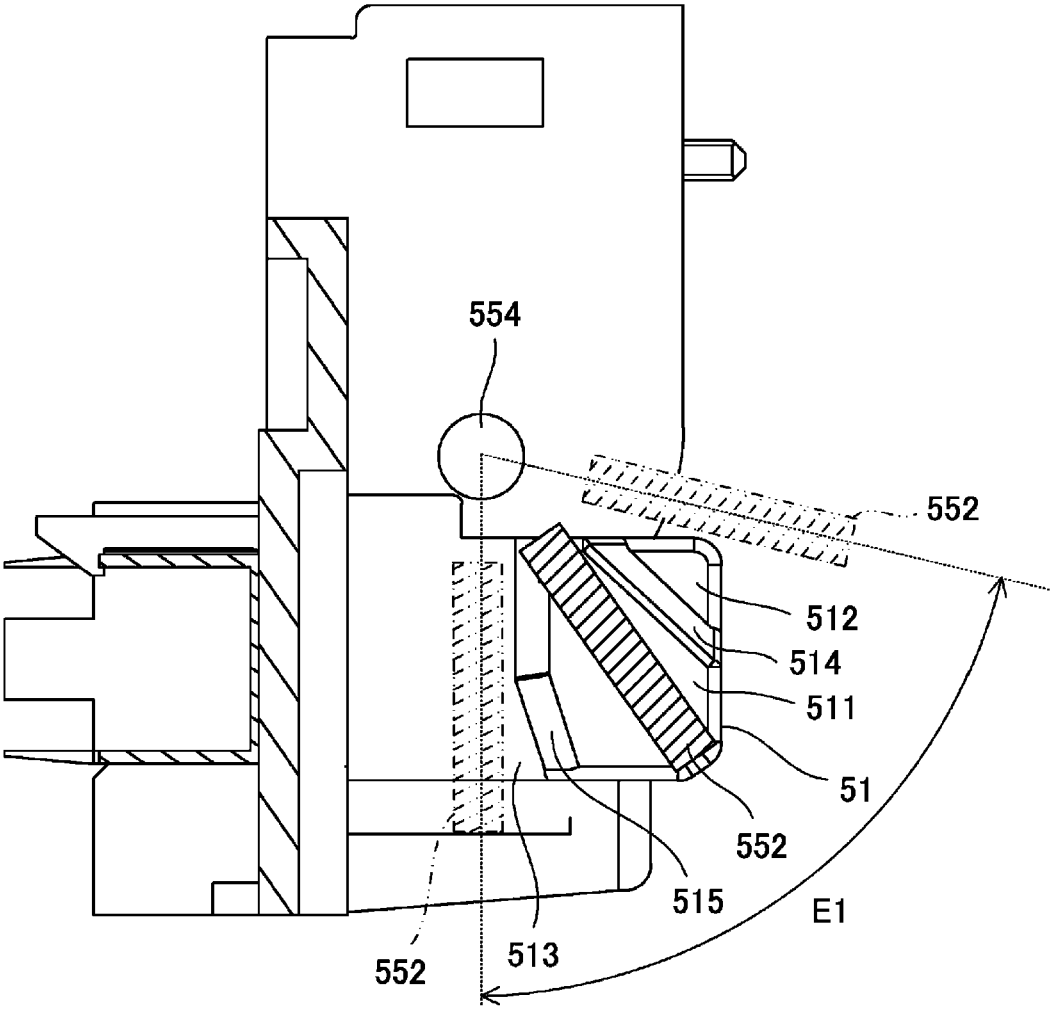
FIG. 8 is a diagram that schematically illustrates motions of a cleaning member provided in the toner detection device.

The support member 551 has a hole portion 555 in a center portion thereof. A portion or all of the toner that falls onto the support member 551 further falls through the hole portion 555 and thus accumulation of the toner on the support member 551 is curbed. In FIGS. 5, 6, and 8, the flexible members 552 and 553 are hatched for convenience of description.

The flexible members 552 and 553 are formed of nitrile-butadiene rubber (NBR), for instance. The flexible members 552 and 553 may be formed of urethane rubber or silicone rubber. The flexible members 552 and 553 have hardness (JIS-A hardness) of 60 degrees, for instance, and it is desirable for the hardness to be 60 degrees or higher and 90 degrees or lower.

With respect to a direction parallel to the shaft portion 554, the flexible member 552 has a base end portion supported by one end portion of the support member 551 and the flexible member 553 has a base end portion supported by the other end portion of the support member 551. In a state in which the support member 551 is placed at an elevation of the detection surfaces 511 of the sensor cases 51, 52, therefore, a leading edge portion of the flexible member 552 is in pressure contact with the detection surface 511 and a leading edge portion of the flexible member 553 is in pressure contact with the detection surface of the sensor case 52.

The cleaning member 55 is rotated and moved about the shaft portion 554 extending in the direction that is orthogonal to the side wall surfaces 424, 425 and thus a distance between the support member 551 and the detection surface 511 and a distance between the support member 551 and the detection surface of the sensor case 52 are fixed irrespective of a position of the support member 551 along rotation directions of the support member 551.

As illustrated in FIG. 6, a dimension L1 between the leading edge portion of the flexible member 552 and the leading edge portion of the flexible member 553 in the direction that is orthogonal to the side wall surfaces 424, 425 is greater than a distance L2 between the detection surfaces 511 of the sensor cases 51, 52. It is desirable for the dimension L1 to be smaller than a distance L3 between the step surfaces 512.

Figure 7:
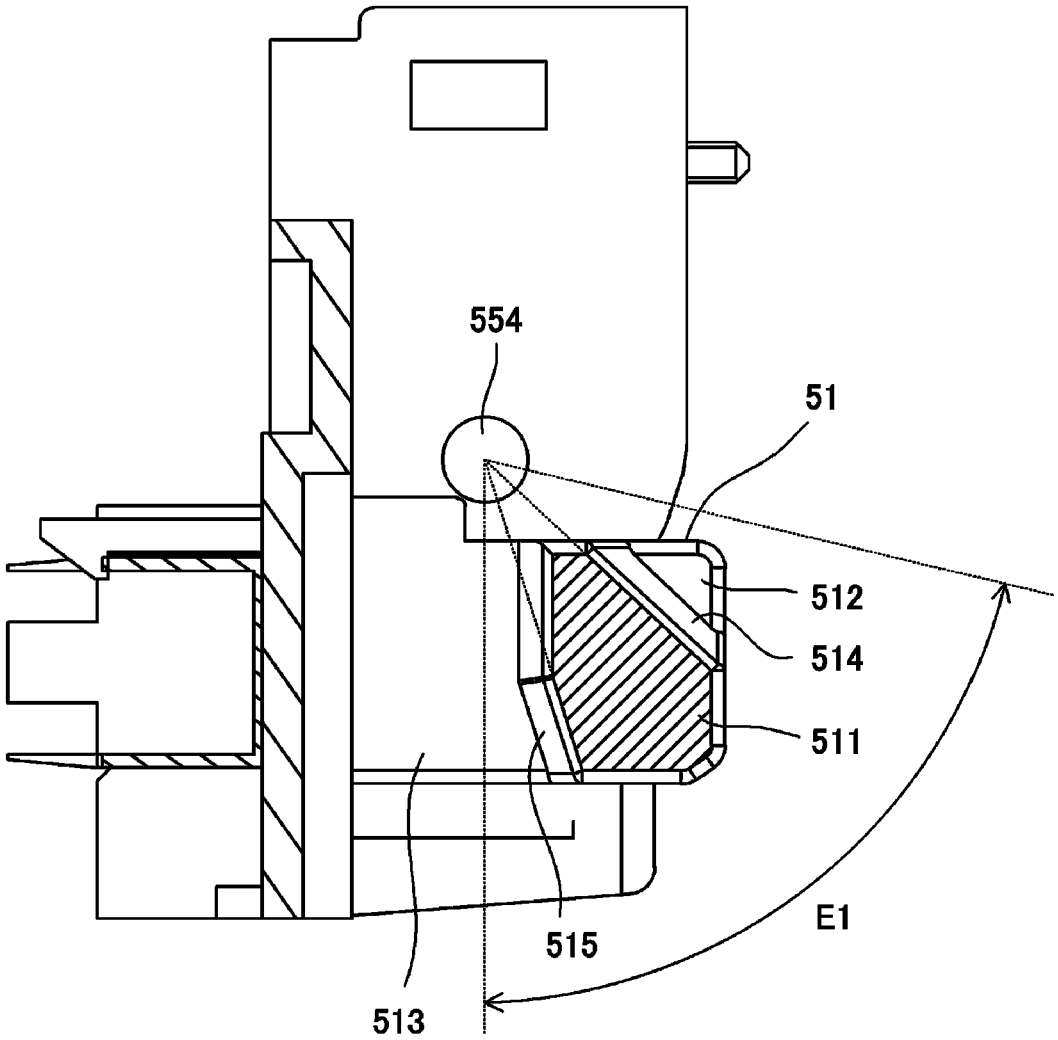
FIG. 7 is a front sectional view in which a portion of the hopper is enlarged.

As illustrated in FIG. 7, at least parts of the step portion 514 between the detection surface 511 and the step surface 512 and of the step portion 515 between the detection surface 511 and the step surface 513 extend in radial directions with respect to the shaft portion 554. In FIG. 7, the detection surface 511 is hatched for convenience of description.

As illustrated in FIG. 8, the cleaning member 55 may reciprocate in an arc about the shaft portion 554 in a moving region E1 including a region facing the detection surfaces 511 of the sensor cases 51, 52 and regions facing the step surfaces 512, 513.

In case where the cleaning member 55 is to be stopped, the cleaning member 55 may be stopped in a region in which the cleaning member 55 does not come into contact with the detection surfaces 511. Thus the cleaning member 55 is not stopped in a state in which the toner is caught between the detection surfaces 511 and the cleaning member 55 and the toner can be inhibited from being made to adhere onto the detection surfaces 511 by pressures produced between the detection surfaces 511 and the cleaning member 55. Though it is desirable for the sensor cases 51, 52 to include the step surfaces 512, 513 and the step portions 514, 515, the first embodiment is not limited to the sensor cases 51, 52 including the step surfaces 512, 513 and the step portions 514, 515.

The flexible members 552, 553 slide and rub on outer surfaces of the detection surfaces 511 of the sensor cases 51, 52 while being in pressure contact with the detection surfaces 511. Thus the toner is removed from the outer surfaces of the detection surfaces 511 even if the toner is deposited on the outer surfaces of the detection surfaces 511.

Cleaning capability is particularly enhanced when the flexible members 552, 553 are curved in an ideal direction such that the leading edge portions of the flexible members 552, 553 which are in pressure contact with the detection surfaces 511 are positioned on a rear side of the base end portions of the flexible members 552, 553 which are supported by the support member 551 with respect to a moving direction of the flexible members 552, 553.

In the hopper 40, distances between the support member 551 and the step surfaces 512, 513 are greater than the distances between the support member 551 and the detection surfaces 511. Accordingly, the flexible members 552, 553 are brought into a curved state in the region facing the detection surfaces 511 and are brought, in the regions facing the step surfaces 512, 513, into an open state in which the flexible members 552, 553 are not curved without contact with the step surfaces 512, 513 or a slightly curved state in which the flexible members 552, 553 have a greater radius of curvature than in the curved state in the region facing the detection surfaces 511, that is, in which a degree of curve is smaller. The step portions 514, 515 exist between the detection surfaces 511 and the step surfaces 512, 513 and thus the flexible members 552, 553 are instantaneously restored from the curved state to the open state or the slightly curved state by elastic forces when moving from the region facing the detection surfaces 511 to the regions facing the step surfaces 512, 513. In case where a lump of the toner has been deposited on the flexible members 552, 553 and/or the support member 551, the lump of the toner can be removed by this configuration from the flexible members 552, 553 and/or the support member 551.

The cleaning member 55 is configured to move in the moving region E1 including the region facing the detection surfaces 511 and the regions facing the step surfaces 512, 513. Thus the flexible members 552, 553 inevitably pass through the region facing the step surface 512 or 513 before moving in a returning direction after moving in a going direction in the region facing the detection surfaces 511 and before moving in the going direction after moving in the returning direction in the same region. Therefore, the flexible members 552, 553 are temporarily brought into the open state after moving in the going direction in the region facing the detection surfaces 511 and thus can be made prone to curve in the ideal direction for the returning direction when moving in the returning direction in the region facing the detection surfaces 511. The same applies when the flexible members 552, 553 move in the going direction on the detection surfaces 511 after moving in the returning direction in the region facing the detection surfaces 511 and passing through the region facing the step surface 512 or 513.

Furthermore, the step portions 514, 515 between the detection surfaces 511 and the step surfaces 512, 513 extend in the radial directions with respect to the shaft portion 554, as described above, so that a longitudinal direction of the cleaning member 55 may be made parallel to either of the directions in which the step portions 514, 515 between the detection surfaces 511 and the step surfaces 512, 513 extend. Therefore, timing of contact and separation of portions of the flexible members 552, 553 with and from the detection surfaces 511 is made uniform when the cleaning member 55 moves between the region facing the detection surfaces 511 and the regions facing the step surfaces 512, 513. As a result, nonuniform curving of the portions of the flexible members 552, 553 in different directions is curbed and the portions are generally made prone to be curved in the ideal direction. The whole flexible members 552, 553 are simultaneously and instantaneously restored from the curved state and thus the lump of the toner could more easily be removed from the flexible members 552, 553 and/or the support member 551.

It is desirable for the flexible members 552 and 553 to be configured so as not to come into contact with any of surfaces the flexible members 552, 553 can face, such as the detection surfaces 511 and the step surfaces 512, 513, while the cleaning member 55 is stopped. Consequently, the flexible members 552, 553 are inhibited from being left in the curved state or the slightly curved state for a long time, so that inhibition of deterioration and extension of lives of the flexible members 552, 553 can be attained.

Second Embodiment

When the presence or absence of the toner is detected by the optical sensors 53, 54, it is desirable to carry out such processing as follows. The determination of the presence or absence of the toner at the specified elevation in the hopper container 42 is iterated while the toner is supplied from the toner cartridge 30 to the hopper 40 and while the development tank 21 is replenished with the toner from the hopper 40. Besides, the cleaning member 55 and the stirring member 43 continue to rotate while the toner is supplied from the toner cartridge 30 to the hopper 40 and while the development tank 21 is replenished with the toner from the hopper 40.

Figure 9:
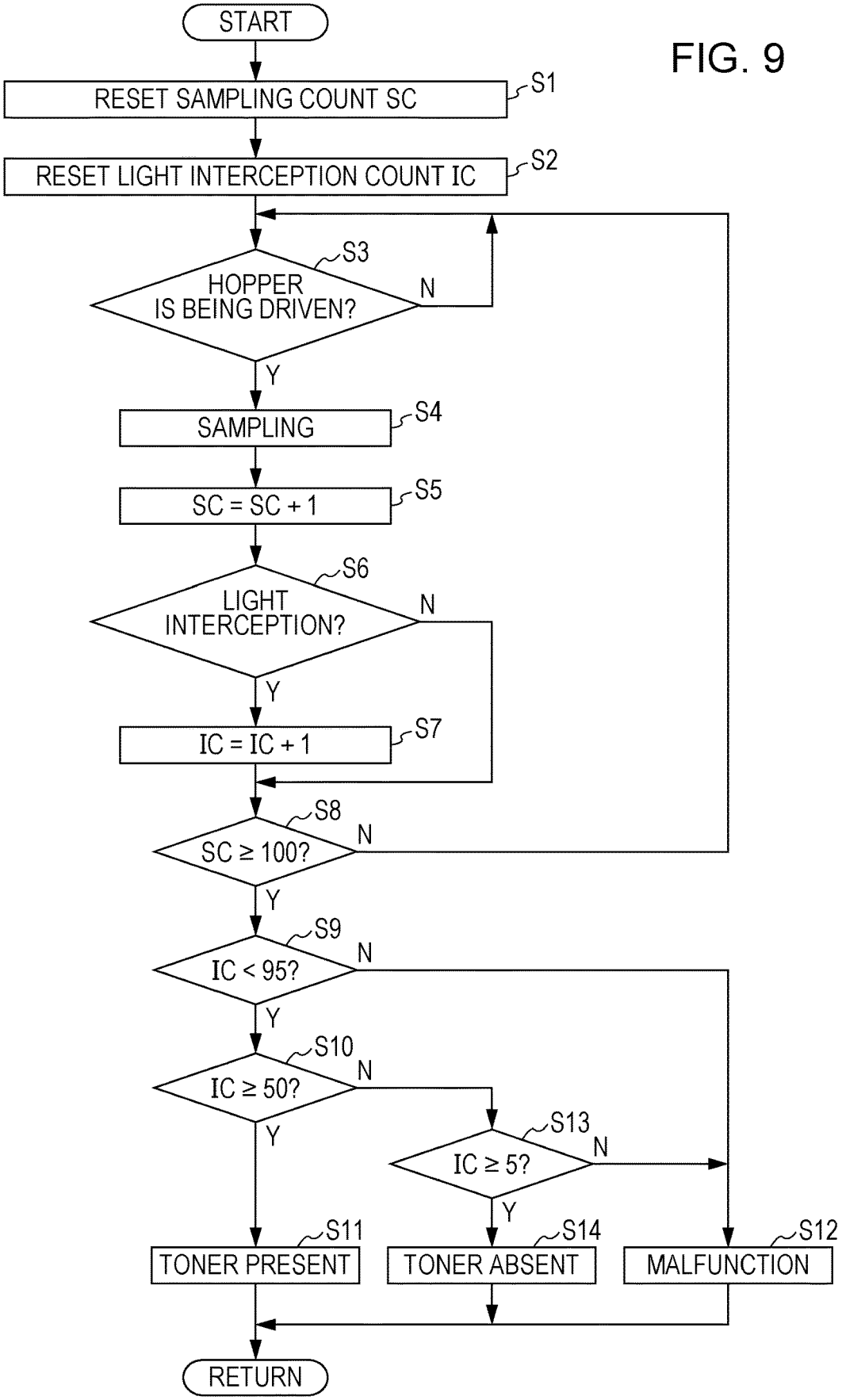
FIG. 9 is a flow chart that illustrates a processing procedure for determination of presence or absence of toner.

As illustrated in FIG. 9, the control unit 11 initially resets a sampling count SC for the output values from the optical sensor 54 (S1). The control unit 11 also resets a light interception count IC that is a count of sampling of the output value from the optical sensor 54 indicating the light interception state (S2). As an instance, 1 (High) is outputted in the light interception state and 0 (Low) is outputted in the transmissive state.

If the motor 556 that moves the cleaning member 55 in the hopper 40 is being driven (S3), the control unit 11 may sample the output values from the optical sensor 54 at uniform intervals (S4). In the embodiment, such sampling is carried out at intervals of twenty thousandths of a second, that is, 20 msec. The control unit 11 adds one to the sampling count SC each time the control unit 11 carries out the sampling (S5).

If the output value (High) indicating the light interception state is sampled (S6), the control unit 11 adds one to the light interception count IC (S7). If the output value (Low) indicating the transmissive state is sampled, the control unit 11 iterates the sampling until the sampling count SC reaches a specified number, such as 100, without addition to the light interception count IC (S8).

If the light interception count IC is smaller than 95 (S9) and equal to or greater than 50 (S10), the control unit 11 may determine that the toner is contained up to the specified elevation at which the optical sensors 53, 54 are placed (S11).

The optical sensor 54 outputs the value (High) indicating the light interception state while the cleaning member 55 passes through the light path between the optical sensors 53, 54, whether the toner is present or absent at the elevation of the light path between the optical sensors 53, 54. On condition that the toner is present up to the elevation of the light path between the optical sensors 53, 54, the optical sensor 54 similarly outputs the value (High) indicating the light interception state. When the cleaning member 55 slides and rubs on the detection surfaces 511 even if the toner is present at the elevation of the light path between the optical sensors 53, 54, however, the toner is temporarily removed from around the detection surfaces 511 and the toner returns to between the optical sensor 53 and the optical sensor 54 due to flowability of the toner after a short time. Therefore, the optical sensor 54 outputs the value (Low) indicating the transmissive state during the short time after the cleaning member 55 passes through the light path between the optical sensors 53, 54. On condition that the toner is not present up to the elevation of the light path between the optical sensors 53, 54, the optical sensors 53, 54 output the value (Low) indicating the transmissive state, except for periods when the cleaning member 55 passes through the light path between the optical sensors 53, 54.

In the toner detection device 50 in which the optical sensors 53, 54 are employed, accordingly, it can be determined that the toner is contained up to the specified elevation in the hopper container 42, on condition that the light interception count IC for the output value (High) indicating the light interception state among the specified count of the sampling is equal to or greater than a specified first threshold. In the embodiment, it is determined that the toner is contained up to the specified elevation in the hopper container 42, on condition that the light interception count IC for the output value (High) indicating the light interception state among 100 times of the sampling is equal to or greater than 50. Thus the presence or absence of the toner at the specified elevation in the hopper container 42 can accurately be detected. Besides, costs can be reduced by use of the optical sensors 53, 54 in comparison with a device in which a piezoelectric sensor is used.

If the light interception count IC is equal to or greater than 95, the control unit 11 determines that there is a malfunction (S12).

The optical sensors 53, 54 output voltage values in accordance with detected contents under application of a voltage. In case where the voltage is not applied due to forgetting of electric connector insertion, disconnection of lead wires, or the like, accordingly, the output value from the optical sensor 54 is the same as the value (High) indicating the light interception state, at all times.

In case where the light interception count IC among 100 times of the sampling is equal to or greater than 95, there is a possibility that the toner may be contained up to the specified elevation in the hopper container 42. Provided that the cleaning member 55 normally moves so as to slide and rub on the detection surfaces 511, however, the value (Low) indicating the transmissive state ought to be outputted for the short time after sliding and rubbing. In case where the light interception count IC makes up an exceedingly large proportion of the sampling count SC, accordingly, a problem is thought to have occurred in that the cleaning member 55 does not move.

If the light interception count IC is equal to or greater than a specified second threshold, such as 95, therefore, the control unit 11 determines that a malfunction occurs in an electrical system or in a drive system for the cleaning member 55 and causes a display unit not illustrated to give error notification.

If the light interception count IC is smaller than the first threshold and equal to or greater than a third threshold, for instance, smaller than 50 and equal to or greater than 5 (S13), the control unit 11 determines that the toner is absent at the elevation of the light path between the optical sensors 53, 54, that is, that the toner is not contained up to the specified elevation in the hopper container 42 (S14). That is because the toner is thought to be absent at the elevation of the optical sensors 53, 54 for a reason that the value (Low) indicating the transmissive state has been sampled in a majority of the sampling count SC. The output value indicating the light interception state may be sampled even if the toner is absent at the elevation of the optical sensors 53, 54 because the sampling may be carried out at timing when the cleaning member 55 passes through the light path between the optical sensors 53, 54.

If the light interception count IC is smaller than the third threshold, that is, smaller than 5 as well, the control unit 11 determines that there is a malfunction. That is because the light interception count IC equal to or greater than five is thought to be given as long as the cleaning member 55 normally moves even if the toner is absent at the elevation of the optical sensors 53, 54. The first threshold, the second threshold, and the third threshold are positive integers and a relation of SC>the second threshold>the first threshold>the third threshold>0 holds among the thresholds.

Third Embodiment

Figure 10:
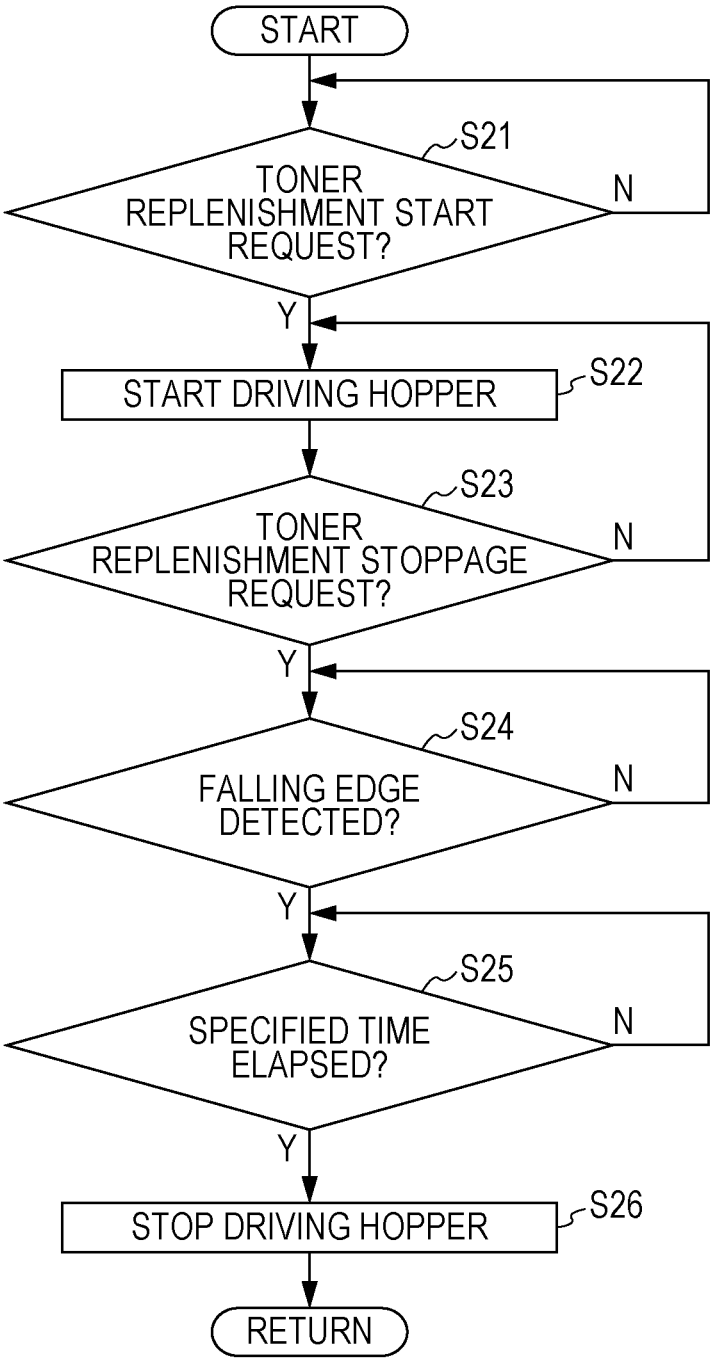
FIG. 10 is a flow chart that illustrates a processing procedure for operations of supplying the toner from a toner cartridge to the hopper.
Figure 11:
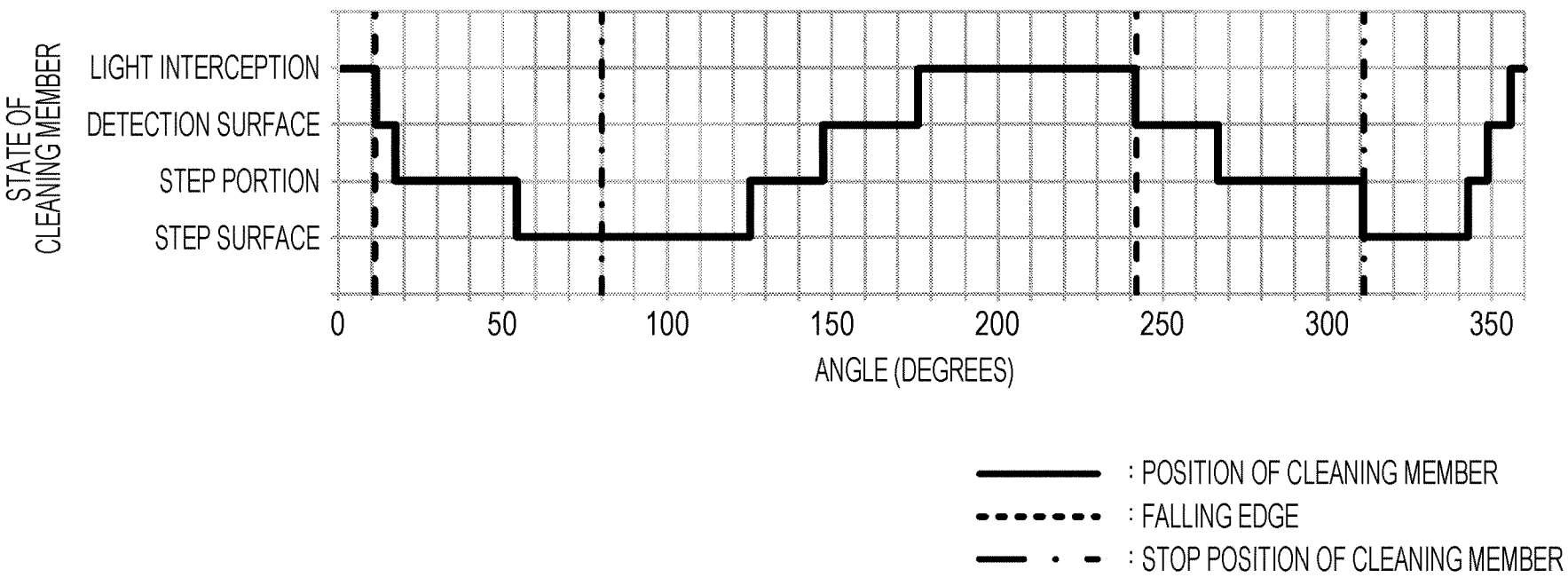
FIG. 11 is a diagram that illustrates relation between moving angles of the cleaning member and states of the cleaning member.

As illustrated in FIGS. 10 and 11, it is desirable to process operations of supplying the toner from the toner cartridge 30 to the hopper 40 as follows. In case where the cleaning member 55 is to be stopped, it is desirable for the control unit 11 to stop the cleaning member 55 after a specified time has elapsed since a transition from a light interception period in which the light path between the optical sensors 53, 54 is intercepted to a transmissive period in which the light path between the optical sensors 53, 54 is transmissive. Specifically, the operations are processed as follows.

If the control unit 11 determines that the toner is not contained up to the specified elevation in the hopper container 42, the control unit 11 then determines that a start request for toner replenishment from the toner cartridge 30 to the hopper 40 is made (S21) and starts driving the motor 556 for the hopper 40 that rotates the cleaning member 55 and driving a motor that rotates the supply roller 31 (S22). Consequently, an amount of the toner in accordance a quantity of rotation of the supply roller 31 is supplied from the toner cartridge 30 to the hopper 40. The sampling is carried out at uniform intervals while the toner is supplied from the toner cartridge 30 to the hopper 40. While the toner is supplied from the toner cartridge 30 to the hopper 40, it is desirable to determine whether or not the toner is contained up to the specified elevation in the hopper container 42, based on the processing for the determination of the presence or absence of the toner that is illustrated in FIG. 9. The control unit 11 continues supply of the toner from the toner cartridge 30 to the hopper 40 until the toner is contained up to the specified elevation in the hopper container 42.

If determining that the toner is contained up to the specified elevation in the hopper container 42, the control unit 11 then determines that a stoppage request for the toner supply from the toner cartridge 30 to the hopper 40 is made (S23) and detects a falling edge that is timing of the transition from the light interception period to the transmissive period (S24).

In FIG. 11, a vertical axis represents states of the cleaning member 55, such as sites on the sensor cases 51, 52 the cleaning member 55 faces and presence or absence of the state in which the light path between the optical sensors 53, 54 is intercepted. A horizontal axis represents cumulative moving angles of the cleaning member 55 from a position.

As illustrated in FIG. 11, the cleaning member 55 reciprocates so as to sequentially face the step surface 512, the step portion 514, the detection surface 511, the step portion 515, the step surface 513, the step portion 515, the detection surface 511, the step portion 514, and the step surface 512, in order of mention. The cleaning member 55 passes through the light path between the optical sensors 53, 54 when moving in both the going direction and the returning direction and sliding and rubbing on the detection surfaces 511.

The light path between the optical sensors 53, 54 is intercepted while the cleaning member 55 passes through the light path between the optical sensors 53, 54, whether the toner is present or absent at the elevation of the light path between the optical sensors 53, 54. Further, the optical sensor 54 outputs the value (Low) indicating the transmissive state during the short time after the cleaning member 55 passes through the light path between the optical sensors 53, 54, whether the toner is present or absent at the elevation of the light path between the optical sensors 53, 54. Therefore, the timing of the transition from the light interception period to the transmissive period, that is, the falling edges illustrated by dashed lines in FIG. 11 can be determined as timing of passage of the cleaning member 55 through the light path between the optical sensors 53, 54. In FIG. 11, as an instance, the timings at 11 degrees and 242 degrees are detected as the falling edges.

After the specified time has elapsed since the timing of the transition from the light interception period to the transmissive period, that is, since the falling edge (S25), the control unit 11 stops the cleaning member 55 by stopping drive of the motor 556 for the hopper 40 that rotates the cleaning member 55 (S26). It is desirable to stop the motor that rotates the supply roller 31 concomitantly with stoppage of the cleaning member 55.

Thus the cleaning member 55 can be stopped in a region not facing the detection surfaces 511. That is, the cleaning member 55 can be stopped on the step surface 512, 513 or the step portion 514, 515. Thus the toner caught between the detection surfaces 511 and the cleaning member 55 can be inhibited from being made to adhere onto the detection surfaces 511 by the pressures produced between the detection surfaces 511 and the cleaning member 55.

The specified time between the falling edge and the stoppage of the cleaning member 55 can be determined as follows.

As an instance, a time it takes for the cleaning member 55 to go and return (move by 360 degrees) one time is assumed to be 2000 msec. It is also assumed that the cleaning member 55 reaches the region not facing the detection surfaces 511 by moving 69 degrees from the falling edges. Based on such assumptions, the specified time is calculated as follows.

$$69/360\times2000=383\ (\text{msec})$$

Accordingly, the control unit 11 stops the cleaning member 55 after 383 msec have elapsed since detection of the falling edge. In this example in FIG. 11, the cleaning member 55 is to be stopped at positions with the angles of 80 degrees and 311 degrees.

Fourth Embodiment

Figure 12:
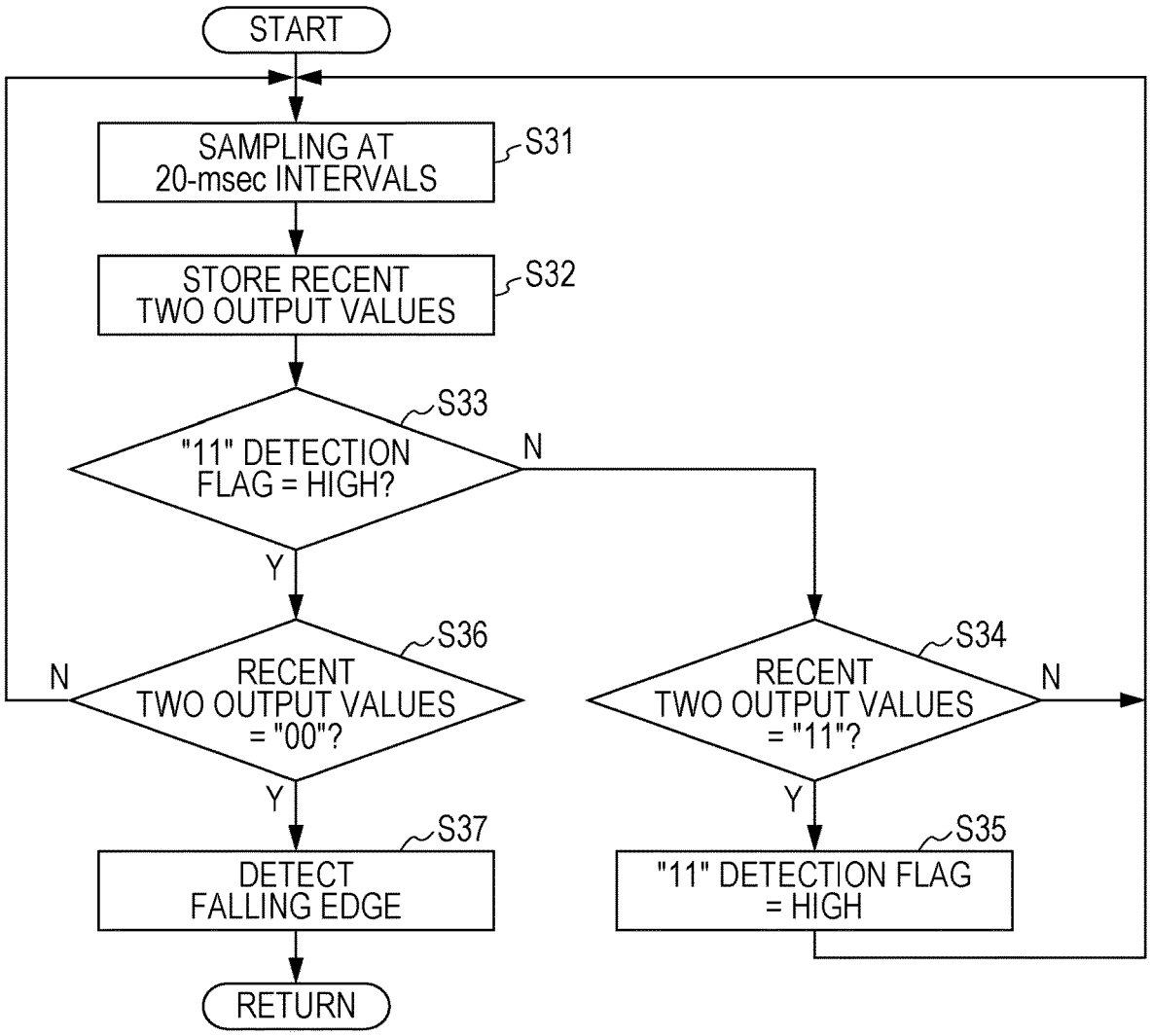
FIG. 12 is a flow chart that illustrates a processing procedure for detection of a falling edge.
Figure 13:
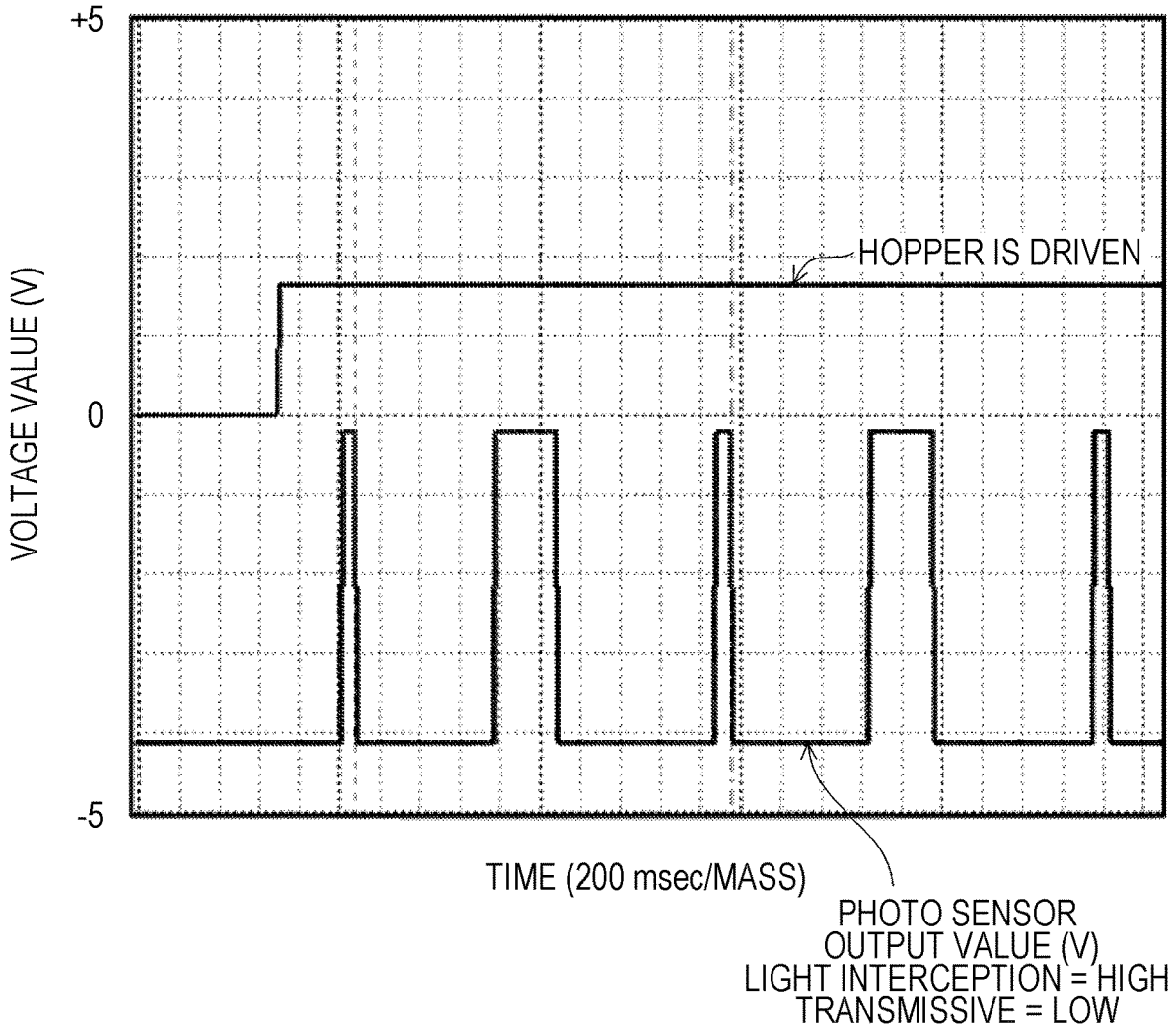
FIG. 13 is a diagram that illustrates relation between output values from an optical sensor and time.
Figure 14:
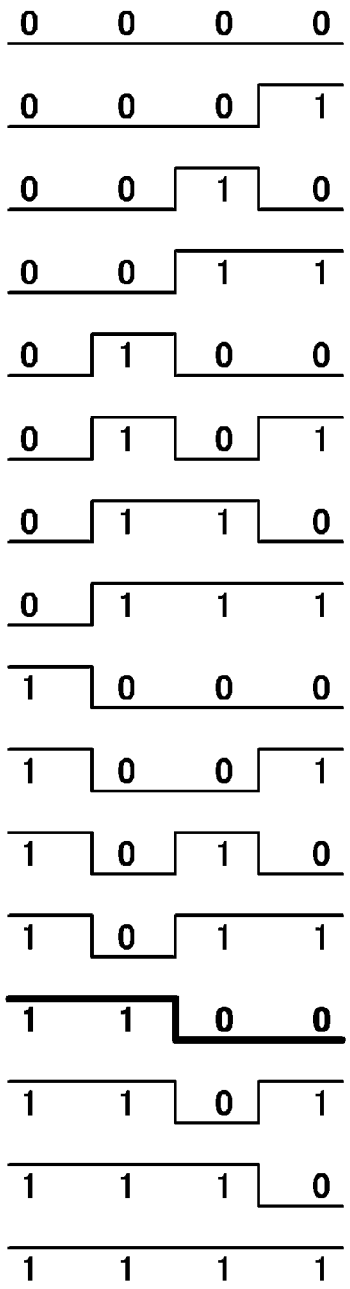
FIG. 14 is a diagram that illustrates a plurality of patterns of the output values from the optical sensor.

As illustrated in FIGS. 12, 13, and 14, it is desirable to identify the timing of the transition from the light interception period to the transmissive period, that is, the falling edge as follows. It is desirable for the control unit 11 to determine that the transition from the light interception period to the transmissive period has been made, on condition that the output value of 1 (High) indicating the light interception state is consecutively sampled a plurality of times and that the output value of 0 (Low) indicating the transmissive state is thereafter consecutively sampled a plurality of times. Specifically, such operations are processed as follows.

The control unit 11 carries out the sampling at uniform intervals of 20 msec, for instance, (S31) and stores recent two output values from the optical sensor 54 in a memory not illustrated (S32).

If a "11" detection flag indicating that the output value of 1 indicating the light interception state from the optical sensor 54 has been sampled consecutively two times, for instance, is not High (S33), the control unit 11 iterates the sampling until both recent two output values from the optical sensor 54 become 1 (S34).

As illustrated in FIG. 13, a time it takes for the cleaning member 55 to pass through the light path between the optical sensors 53, 54 is sufficiently longer than the intervals of the sampling. Therefore, the output value of 1 (High) indicating the light interception state is sampled a plurality of times while the cleaning member 55 passes through the light path between the optical sensors 53, 54 one time.

If the recent two output values from the optical sensor 54 are "11", the control unit 11 sets the "11" detection flag to be High (S35).

In a state in which the "11" detection flag is set to be High, the control unit 11 iterates the sampling until both recent two output values from the optical sensor 54 become 0 (S36).

Thus the control unit 11 determines timing when four consecutive output values from the optical sensor 54 become "1100" among various combinations, as illustrated in FIG. 14, as the timing of the transition from the light interception period to the transmissive period, that is, the falling edge (S37).

As a result, a false positive for the falling edge due to noises can be inhibited even if the output value from the optical sensor 54 becomes 1 (High) due to the noises. Thus the cleaning member 55 can accurately be stopped in a region not facing the detection surfaces 511 in case where the cleaning member 55 is to be stopped.

Fifth Embodiment

The cleaning member 55 may be configured to rotate in one direction without limitation to the configuration of reciprocation. In this configuration in which the cleaning member 55 is rotated in one direction as well, the flexible members 552, 553 alternately move to the region facing the detection surfaces 511 and to the regions facing the step surfaces 512, 513 and, in case where a lump of the toner has been deposited on the flexible members 552, 553 and/or the support member 551, the lump of the toner can be removed from the flexible members 552, 553 and/or the support member 551.

Sixth Embodiment

Placement of the shaft portion 554 of the cleaning member 55 is not limited to the placement along the direction orthogonal to the side wall surfaces 424, 425. In a configuration in which the shaft portion 554 is placed along a direction parallel to the side wall surfaces 424, 425 and the detection surface 511 as well, the toner can be removed from the detection surfaces 511 and the presence or absence of the toner at the specified elevation in the hopper container 42 can accurately be detected at a low cost.

A reflective optical sensor in which a light emitting element and a light receiving element are integrated may be used in place of the optical sensors 53, 54.

The disclosure may be applied to detection of powder other than toner.

A novel embodiment can be configured by combination of technical characteristics of the embodiments described above within a scope not incurring contradiction.

It is to be understood that above description on the embodiments is not limitative but exemplary in all respects. The scope of the disclosure is not defined by the embodiments described above but is defined by the appended claims. Further, it is intended that the scope of the disclosure includes equivalents of the claims and all modifications within the scope.

The present disclosure contains subject matter related to that disclosed in Japanese Priority Patent Application JP 2016-086813 filed in the Japan Patent Office on Apr. 25, 2016, the entire contents of which are hereby incorporated by reference.

What is claimed is:

1. A powder detection device comprising:

a sensor case that is provided on a wall surface of a powder container which contains powder and that includes a transparent detection surface which is placed so as to face inward in the powder container;

an optical sensor that is housed in the sensor case and that detects presence or absence of the powder at an elevation at which the optical sensor is placed, through the detection surface;

a cleaning member that slides and rubs on an outer surface of the detection surface;

a drive unit that moves the cleaning member; and a control unit that controls the drive unit so as to stop the cleaning member in a region in which the cleaning member does not come into contact with the detection surface, in case where the cleaning member is to be stopped.

2. The powder detection device according to claim 1, wherein the sensor case further includes a step surface that is spaced farther away from the cleaning member than the detection surface in a direction orthogonal to the detection surface, and the cleaning member includes a flexible member that slides and rubs on the detection surface and a support member that supports the flexible member, and the cleaning member is configured to move in a moving region including a region facing the detection surface and a region facing the step surface.

3. The powder detection device according to claim 2, wherein the flexible member is configured not to contact the step surface when the flexible member is in the region facing the step surface.

4. The powder detection device according to claim 1, wherein the control unit samples output values from the optical sensor at uniform intervals while the cleaning member is moving, and the control unit determines that the powder is contained up to the elevation in the powder container on condition that a sampling count for the output value indicating a light interception state among a specified count of sampling is equal to or greater than a specified threshold.

5. The powder detection device according to claim 1, wherein the control unit samples output values from the optical sensor at uniform intervals while the cleaning member is moving, and the control unit stops the cleaning member after a specified time has elapsed since a transition from a light interception period in which a light path of the optical sensor is intercepted to a transmissive period in which the light path of the optical sensor is transmissive in case where the cleaning member is to be stopped.

6. The powder detection device according to claim 5, wherein the control unit determines that the transition from the light interception period to the transmissive period has been made, on condition that the output value indicating a light interception state is consecutively sampled a plurality of times and that the output value indicating a transmissive state is thereafter consecutively sampled a plurality of times.

7. A toner replenishment device, wherein the powder is toner, the toner replenishment device includes the powder detection device according to claim 1 and the powder container, and the powder container includes a receiving port which receives supply of the toner from a toner cartridge detachably attached to the powder container and a discharge port through which the toner supplied from the toner cartridge is discharged toward a development tank to be replenished with the toner after the toner is temporarily stored.

* * * * *